US011371511B2

(12) United States Patent
Kato

(10) Patent No.: US 11,371,511 B2
(45) Date of Patent: Jun. 28, 2022

(54) DIAGNOSTIC APPARATUS FOR FUEL PUMP

(71) Applicant: TOYOTA JIDOSHA KABUSHIKI KAISHA, Toyota (JP)

(72) Inventor: Ryosuke Kato, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/775,618

(22) Filed: Jan. 29, 2020

(65) Prior Publication Data

US 2020/0263683 A1 Aug. 20, 2020

(30) Foreign Application Priority Data

Feb. 15, 2019 (JP) ..... JP2019-025554

(51) Int. Cl.

| | |
|---|---|
| ***F04D 15/02*** | (2006.01) |
| ***F04D 15/00*** | (2006.01) |
| ***F04D 5/00*** | (2006.01) |
| ***F04D 29/42*** | (2006.01) |
| ***F04D 29/18*** | (2006.01) |
| ***F04D 17/08*** | (2006.01) |

(52) U.S. Cl.

CPC ..... *F04D 15/0272* (2013.01); *F04D 5/002* (2013.01); *F04D 15/0088* (2013.01); *F04D 17/08* (2013.01); *F04D 29/18* (2013.01); *F04D 29/42* (2013.01)

(58) Field of Classification Search

CPC .. F04D 15/0272; F04D 15/0088; F04D 5/002; F04D 29/18; F04D 29/42; F04D 17/08

See application file for complete search history.

(56) References Cited

U.S. PATENT DOCUMENTS 5,012,420 A * 4/1991 Walker ..... F01D 11/24 415/1
5,385,442 A * 1/1995 Lehe ..... F04D 29/2266 415/104
6,126,386 A * 10/2000 Kohyama ..... F04D 29/188 415/55.1

(Continued)

FOREIGN PATENT DOCUMENTS

CN 101106347 A 1/2008
JP 2002-168188 A 6/2002

(Continued)

OTHER PUBLICATIONS

Mar. 10, 2022 Office Action issued in Chinese Patent Application No. 202010088107.1.

(Continued)

*Primary Examiner* — Christopher S Bobish
(74) *Attorney, Agent, or Firm* — Oliff PLC

(57) ABSTRACT

A diagnostic apparatus for a fuel pump diagnoses the state of a fuel pump based on: a correlation between a pump rotational speed that is a rotational speed of the motor and fuel pressure that is pressure of the fuel discharged from the fuel pump; and an initial correlation that is the correlation in an initial actuation period from when the fuel pump is energized for the first time to when a specified period has elapsed.

3 Claims, 6 Drawing Sheets

(56) References Cited

U.S. PATENT DOCUMENTS

| | | | | |
|---|---|---|---|---|
| 6,155,038 | A * | 12/2000 | Irwin | F02C 9/28 60/782 |
| 6,260,004 | B1 * | 7/2001 | Hays | F04D 15/0088 702/183 |
| 10,253,718 | B2 * | 4/2019 | Grime | F02M 37/18 |
| 2002/0054814 | A1 * | 5/2002 | Honma | F04D 29/026 415/55.1 |
| 2014/0169960 | A1 * | 6/2014 | Hamatani | F04D 29/026 415/230 |

FOREIGN PATENT DOCUMENTS

| | | | |
|---|---|---|---|
| JP | 2007-247634 | A | 9/2007 |
| WO | 2013/054412 | A1 | 4/2013 |

OTHER PUBLICATIONS

Zhong-Sheng, Wang. "Performance Monitoring and Fault Diagnosis on the Fuel Pump". Acta Aeronautica at Astronautica Sinica, vol. 14, No. 6, pp. 263-267, 1993.

* cited by examiner

DIAGNOSTIC APPARATUS FOR FUEL PUMP

BACKGROUND

1. Field

The present disclosure relates to a diagnostic apparatus for a fuel pump.

2. Description of Related Art

The impeller of a fuel pump draws in fuel from a fuel tank and is exposed to the fuel. This causes the impeller to swell gradually and decreases the size of the clearance between the impeller and the inner wall of a pump chamber accommodating the impeller. In this case, the impeller may interfere with the inner wall of the pump chamber. Such interference may hamper rotation of the impeller and stop the fuel pump.

As disclosed in WO2013/054412, a fuel pump has an impeller and a pump chamber each having a shape determined based on an estimated impeller swelling amount to ensure a clearance that allows the impeller to swell without interference.

If the fuel pump stops due to the swelling of the impeller, fuel supply is blocked. It is thus preferable that the swelling of the impeller be detected before the fuel pump stops.

The fuel pump of the aforementioned document simply has the clearance that is set based on the estimated impeller swelling amount. In other words, the fuel pump is not adapted to determine the state of the fuel pump in actuation. However, to limit the stopping of the fuel pump due to swelling of the impeller, the state of the fuel pump in actuation needs to be determined.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with one aspect, a diagnostic apparatus for a fuel pump mounted in a fuel supply system is provided. The fuel pump has a pump chamber, an impeller accommodated in the pump chamber, and a motor for rotating the impeller. The fuel pump is configured to draw in fuel from a fuel tank and discharge the fuel by rotation of the impeller. The diagnostic apparatus includes processing circuitry that is configured to diagnose a state of the fuel pump based on: a correlation between a pump rotational speed that is a rotational speed of the motor and fuel pressure that is pressure of the fuel discharged from the fuel pump; and an initial correlation that is the correlation in an initial actuation period from when the fuel pump is energized for the first time to when a specified period has elapsed.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A diagnostic apparatus for a fuel pump according to an embodiment will now be described with reference to FIGS. 1 to 6.

Figure 1:
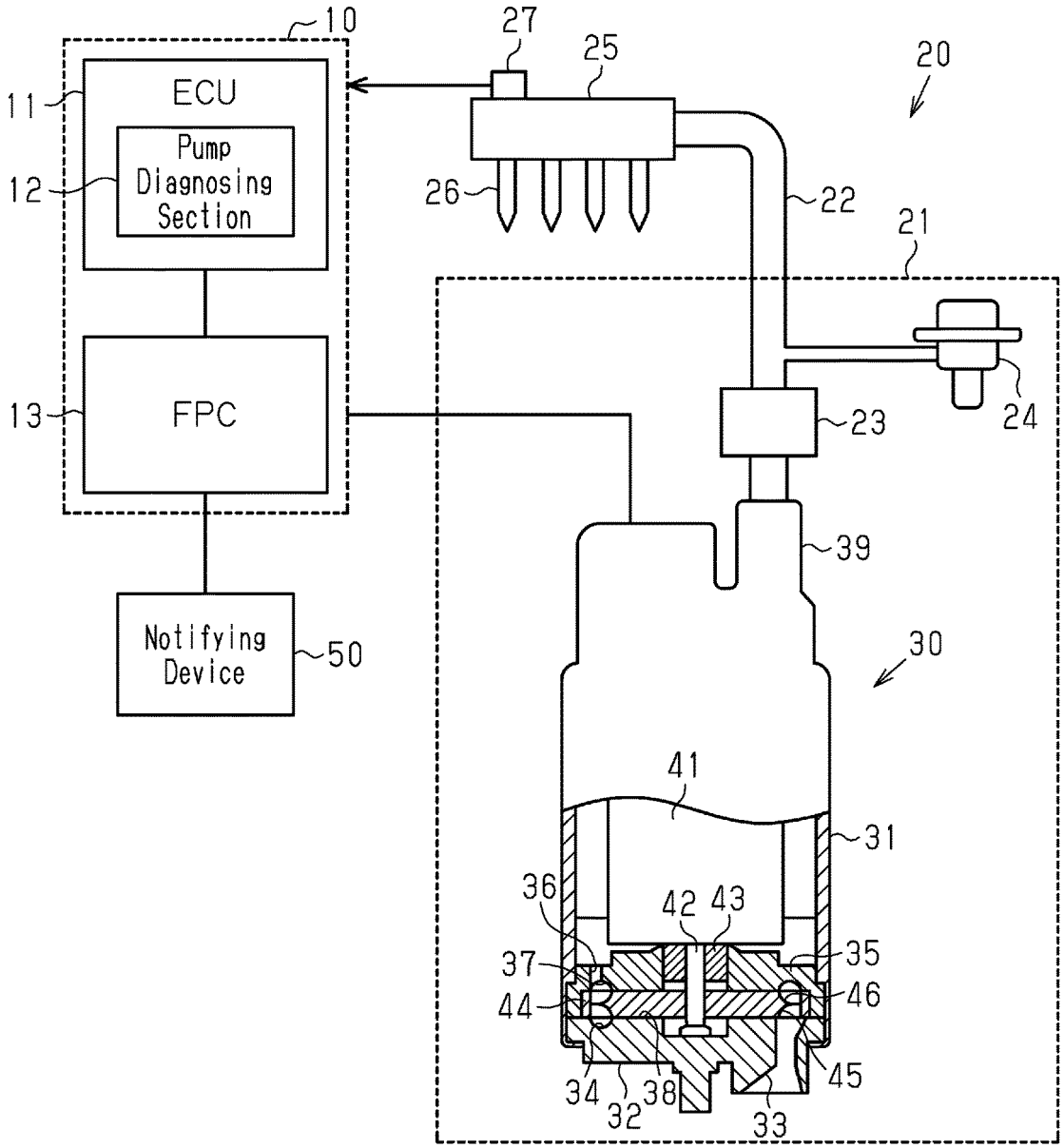
FIG. 1 is a schematic diagram showing a diagnostic apparatus for a fuel pump according to an embodiment and a fuel supply system.

FIG. 1 shows a control unit 10, which is a diagnostic apparatus for a fuel pump 30, and a fuel supply system 20. The fuel pump 30 is included in the fuel supply system 20. The fuel supply system 20 includes a fuel tank 21, the fuel pump 30, and fuel injection valves 26.

Fuel is retained in the fuel tank 21 and discharged into a supply passage 22 by means of the fuel pump 30. A check valve 23 is disposed in the supply passage 22. A pressure regulator 24 is arranged downstream from the check valve 23.

The supply passage 22 is connected to a delivery pipe 25. The delivery pipe 25 has the fuel injection valves 26. A fuel pressure sensor 27 is arranged on the delivery pipe 25.

The fuel pump 30 includes a tubular housing 31. A discharge portion 39 is provided in the housing 31 to discharge fuel. The supply passage 22 is connected to the discharge portion 39. The housing 31 has an opening in an end section at the opposite side to the discharge portion 39. A cover 32 is attached to the opening. The cover 32 has an inlet port 33, through which fuel is drawn in from the fuel tank 21.

The fuel pump 30 includes a motor 41. The motor 41 is accommodated in the housing 31. A casing 35 is attached to the inner side of the housing 31 and has a bearing 43. The bearing 43 supports a shaft 42 of the motor 41. The casing 35 has a discharge passage 36 extending through the casing 35 in the axial direction of the shaft 42.

A plastic impeller 44 is attached to the shaft 42 of the motor 41. The impeller 44 is accommodated in a pump chamber 38 defined by the casing 35 and the cover 32. The impeller 44 is shaped like a disk and has first and second surfaces. The first surface faces the cover 32 and the second surface faces the casing 35. The impeller 44 includes multiple inlet-side fins 45. The inlet-side fins 45 are provided on the first surface and arranged circumferentially. The impeller 44 includes multiple discharge-side fins 46. The discharge-side fins 46 are disposed on the second surface and arranged circumferentially. The impeller 44 has a communication hole (not shown) extending through the impeller 44 in the axial direction of the shaft 42.

The surface of the cover 32 that defines the pump chamber 38 has a first groove 34. The first groove 34 is C-shaped and communicates with the inlet port 33. The surface of the casing 35 that also defines the pump chamber 38, has a second groove 37. The second groove 37 is C-shaped and communicates with the discharge passage 36.

When the motor 41 is actuated to rotate the impeller 44, the inlet-side fins 45 and the discharge-side fins 46 generate swirl flows in the first groove 34 and the second groove 37, respectively, in the fuel pump 30. As fuel swirls in the space between the impeller 44 and the cover 32, the pressure of the fuel rises, thus pushing out some of the fuel into the space between the impeller 44 and the casing 35. The pressure of this fuel is raised by the swirl flow in the second groove 37. The fuel is then pushed out from the second groove 37 through the discharge passage 36 and discharged from the discharge portion 39.

Figure 2:
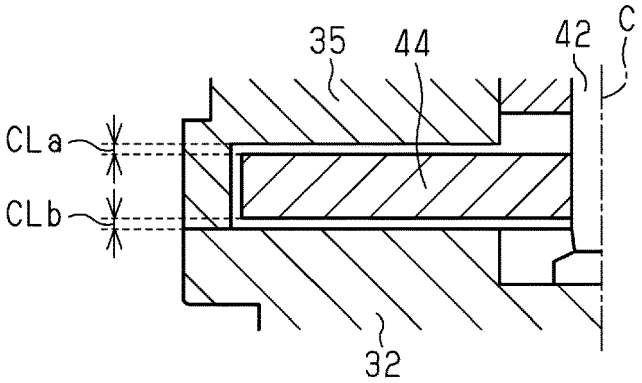
FIG. 2 is a cross-sectional view schematically showing an impeller of the fuel pump and the vicinity of the impeller in the fuel supply system of FIG. 1.

With reference to FIG. 2, clearances are provided between the impeller 44 and the cover 32 and between the impeller 44 and the casing 35. The drawing schematically shows the clearances in an exaggerated manner. The axis C of the shaft 42 is also included in the drawing. The clearance between the impeller 44 and the casing 35 in the extending direction of the axis C is defined as a first clearance CLa. The clearance between the impeller 44 and the cover 32 in the extending direction of the axis C is defined as a second clearance CLb. The sum of the first clearance CLa and the second clearance CLb is defined as a clearance CL. The clearance CL is a thrust clearance in the extending direction of the axis C.

The size of the clearance CL significantly influences the discharge performance of the fuel pump 30. Since the impeller 44 is exposed to fuel, the impeller 44 swells and irreversibly increases its volume. Such swelling of the impeller 44 reduces the clearance CL in size, thus raising the discharge pressure. However, the reduced-size clearance CL causes the impeller 44 to interfere with an inner wall of the pump chamber 38, thus hampering rotation of the impeller 44. This may eventually stop the fuel pump 30. Also, foreign matter may be drawn into the pump chamber 38 and cause the inner wall of the pump chamber 38 or the impeller 44 to wear. This enlarges the clearance CL, thus lowering the discharge pressure.

As illustrated in FIG. 1, the control unit 10 is mounted in a vehicle including the fuel supply system 20. Various sensors are connected to the control unit 10. The control unit 10 detects the fuel pressure QP in the delivery pipe 25 based on a detection signal from the fuel pressure sensor 27, which is an example of the sensors.

The control unit 10 includes an ECU 11 as a controller for the vehicle and an FPC 13 as a pump control section (a pump control circuit) for actuating the fuel pump 30. The control unit 10 or each of the ECU 11 and the FPC 13 included in the control unit 10 may be processing circuitry including: 1) one or more processors that operate according to a computer program (software); 2) one or more dedicated hardware circuits such as application specific integrated circuits (ASIC) that execute at least part of various processes, or 3) a combination thereof. The processor includes a CPU and memories such as a RAM and a ROM. The memories store program codes or commands configured to cause the CPU to execute various processes. The memories, or computer readable media, include any type of media that are accessible by general-purpose computers and dedicated computers.

The ECU 11 includes a pump diagnosing section (a pump diagnostic circuit) 12. The pump diagnosing section 12 carries out a diagnostic procedure to detect a sign of an anomaly in the fuel pump 30.

The FPC 13 actuates and controls the fuel pump 30 based on a requested discharged amount QVT. The requested discharged amount QVT is calculated by the ECU 11. The FPC 13 controls the motor 41 of the fuel pump 30 through feedforward control (hereinafter, referred to as F/F control) and feedback control (hereinafter, referred to as F/B control).

In the F/F control, a target rotational speed NpT is calculated as a target of the pump rotational speed Np based on the requested discharged amount QVT. The FPC 13 sets the motor voltage of the fuel pump 30 such that the pump rotational speed Np achieves the target rotational speed NpT and then actuates the fuel pump 30.

In the F/B control, the actual discharged amount of the fuel pump 30 is estimated based on the fuel pressure QP. The pump rotational speed Np is then controlled such that the actual discharged amount achieves the requested discharged amount QVT.

A notifying device 50 is connected to the control unit 10. An alarm lamp may be employed, for example, as the notifying device 50. If the pump diagnosing section 12 performs a diagnostic procedure and detects a sign of an anomaly in the fuel pump 30 consequently, the pump diagnosing section 12 illuminates the alarm lamp, thus making notification of such detection of the sign.

Figure 3:
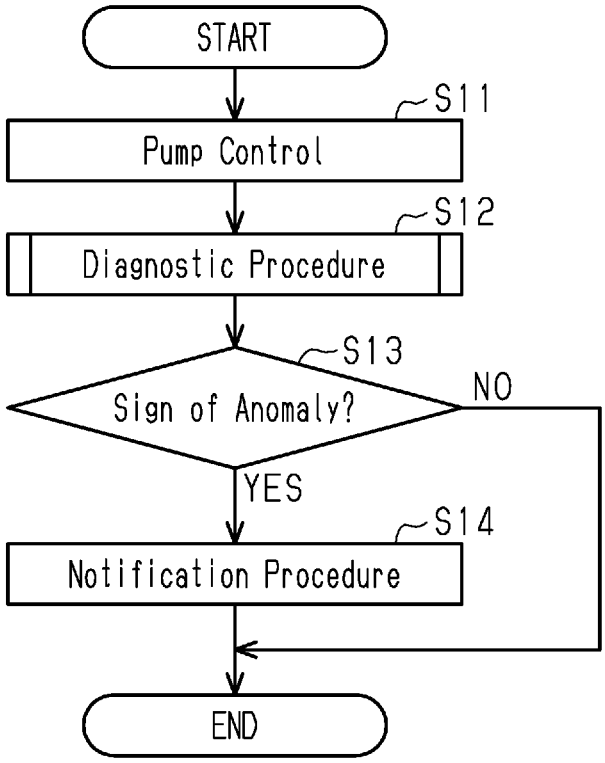
FIG. 3 is a flowchart showing a procedure performed by the diagnostic apparatus of FIG. 1.

With reference to FIG. 3, the flow of the diagnostic procedure performed by the pump diagnosing section 12 will be described. In the flow, the diagnostic procedure is carried out after the pump control performed by the FPC 13.

After the FPC 13 performs the pump control in Step S11, the pump diagnosing section 12 carries out the diagnostic procedure in Step S12. The diagnostic procedure will be described in detail later. After the diagnostic procedure, Step S13 is carried out.

In Step S13, the pump diagnosing section 12 determines whether a sign of an anomaly has been detected through the diagnostic procedure. As will be described in detail later, the diagnostic procedure determines that there is a sign of an anomaly in response to a determination that the impeller 44 has swollen or that an inner wall of the pump chamber 38 or the impeller 44 is worn. The diagnostic procedure determines that there is no sign of an anomaly if any other result is obtained from the diagnosis. In this case (S13: NO), the routine of the current processing is ended.

In contrast, when there is a sign of an anomaly (S13: YES), Step S14 is carried out. In Step S14, the pump diagnosing section 12 performs a notification procedure. In the notification procedure, the pump diagnosing section 12 memorizes the fact that the sign of an anomaly has been detected through the diagnostic procedure and then makes notification of the sign of an anomaly by means of the notifying device 50. After the notification procedure, the routine of the current processing is ended.

The relationship between the pump rotational speed Np and the fuel pressure QP related to the diagnostic procedure will hereafter be described with reference to FIG. 4. The larger the pump rotational speed Np, the higher the discharge pressure of the fuel pump 30 and the fuel pressure QP become.

Hereinafter, a fuel pump in a state with neither swelling of the impeller 44 nor wear of the inner wall of the pump chamber 38 or the impeller 44, that is, a state without a problem, is defined as a reference fuel pump. A fuel pump in a state with progressed swelling of the impeller 44 compared to the reference fuel pump is defined as a fuel pump in a swollen state. A fuel pump in a state with progressed wear of the inner wall of the pump chamber 38 or the impeller 44 compared to the reference fuel pump is defined as a fuel pump in a worn state.

Figure 4:
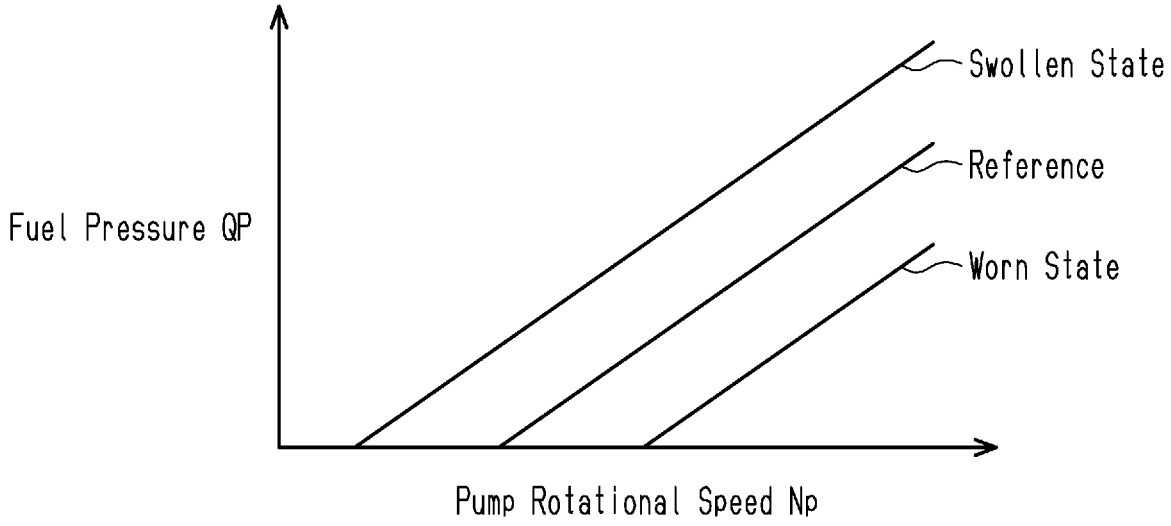
FIG. 4 is a graph showing the relationships between the pump rotational speed and fuel pressure in the respective states of the fuel pump of FIG. 1.

Referring to FIG. 4, in the reference fuel pump, the pump rotational speed Np and the fuel pressure QP exhibit a proportional relationship in the initial actuation period from when the motor is energized for the first time to when a specified period has elapsed. Such relationship is defined as initial correlation. Specifically, the specified period is a period in which the correlation between the pump rotational speed Np and the fuel pressure QP is assumed to remain unchanged regardless of variation in the size of the clearance CL. As shown in FIG. 4, the fuel pressure QP of the fuel pump in a swollen state tends to be higher than that of the reference fuel pump when the fuel pumps are actuated by a predetermined pump rotational speed Np. In other words, in the correlation between the number of motor revolutions Np and the fuel pressure QP of the fuel pump in a swollen state, the fuel pressure QP is higher than that in the initial correlation for the predetermined pump rotational speed Np. In contrast, as shown in FIG. 4, the fuel pressure QP of the fuel pump in a worn state tends to be lower than that of the reference fuel pump when the fuel pumps are actuated by the predetermined pump rotational speed Np. In other words, in the correlation between the number of motor revolutions Np and the fuel pressure QP of the fuel pump in a worn state, the fuel pressure QP is lower than that in the initial correlation for the predetermined pump rotational speed Np. The relationships between the pump rotational speed Np and the fuel pressure QP in the respective states of the fuel pump 30, as shown in FIG. 4, are brought about by variation in the size of the clearance CL. Such variation is caused by the swelling of the impeller 44 or the wear of the inner wall of the pump chamber 38 or the impeller 44.

Next, with reference to FIG. 5, the relationship between the pump rotational speed Np and the clearance CL related to the diagnostic procedure will be described. The graph shows the relationship between the size of the clearance CL and the pump rotational speed Np at the time when the fuel pressure QP rises to a specified pressure QPx though actuation of the fuel pump 30. As shown in FIG. 4, the fuel pressure QP of the fuel pump in a swollen state is relatively high for the predetermined pump rotational speed Np. In contrast, the fuel pressure QP of the fuel pump in a worn state is relatively low for the predetermined pump rotational speed Np. In other words, the larger the clearance CL, the lower the fuel pressure QP for the predetermined pump rotational speed Np. Therefore, referring to FIG. 5, the higher the pump rotational speed Np at the time when the fuel pressure QP rises to the specified pressure QPx, the larger the clearance CL becomes.

The present embodiment sets a reference range of the clearance CL such that the reference range includes the size of the clearance CL of the reference fuel pump. As shown in FIG. 5, the minimum value in the reference range is defined as a lower limit acceptable value CLth2 and the maximum value in the reference range is defined as an upper limit acceptable value CLth3. If the clearance CL of the fuel pump 30 is smaller than the lower limit acceptable value CLth2, it is indicated that the impeller 44 has a tendency to swell as compared to the impeller of the reference fuel pump. The impeller 44 having the tendency to swell refers to the impeller 44 being in a state in which the impeller 44 has swollen but not to such a stage that the impeller 44 interferes with the inner wall of the pump chamber 38. In contrast, if the clearance CL of the fuel pump 30 is larger than the upper limit acceptable value CLth3, it is indicated that the inner wall of the pump chamber 38 or the impeller 44 has a tendency to wear as compared to the corresponding component of the reference fuel pump.

A swelling limit value CLth1 is set to such a value that, if the clearance Cl is smaller than the swelling limit value CLth1, the fuel pump 30 may stop. In other words, as long as the clearance CL of the fuel pump 30 is larger than the swelling limit value CLth1, stopping of the fuel pump 30 caused by the swelling of the impeller 44 does not occur.

Also, a wear limit value CLth4 is set to such a value that, if the clearance CL is larger than the wear limit value CLth4, the discharge performance of the fuel pump 30 is determined to have been lowered.

In other words, the items (A) to (E), as will be described below, are derived from the relationship shown in FIG. 5. Specifically, with reference to the graph, a first threshold rotational speed Npth1, a second threshold rotational speed Npth2, a third threshold rotational speed Npth3, and a fourth threshold rotational speed Npth4 become higher in this order.

(A) If the pump rotational speed Np at the time when the fuel pressure QP rises to the specified pressure QPx is in the range of the second threshold rotational speed Npth2, which corresponds to the lower limit acceptable value CLth2, to the third threshold rotational speed Npth3, which corresponds to the upper limit acceptable value CLth3, the size of the clearance CL of the fuel pump 30 is in the reference range.

(B) If the pump rotational speed Np at the time when the fuel pressure QP rises to the specified pressure QPx is smaller than the second threshold rotational speed Npth2, which corresponds to the lower limit acceptable value CLth2, the clearance CL is smaller than the reference range and the impeller 44 has a tendency to swell.

(C) If the pump rotational speed Np at the time when the fuel pressure QP rises to the specified pressure QPx is smaller than the first threshold rotational speed Npth1, which corresponds to the swelling limit value CLth1, the clearance CL is smaller than the reference range and the fuel pump 30 may stop due to the swelling of the impeller 44.

(D) If the pump rotational speed Np at the time when the fuel pressure QP rises to the specified pressure QPx is greater than the third threshold rotational speed Npth3, which corresponds to the upper limit acceptable value CLth3, the clearance CL is larger than the reference range and the inner wall of the pump chamber 38 or the impeller 44 has a tendency to wear.

(E) If the pump rotational speed Np at the time when the fuel pressure QP rises to the specified pressure QPx is higher than the fourth threshold rotational speed Npth4, which corresponds to the wear limit value CLth4, the clearance CL is larger than the reference range and the performance of the fuel pump 30 has been lowered due to the wear of the inner wall of the pump chamber 38 or the impeller 44.

In other words, the first threshold rotational speed Npth1 is the value of the pump rotational speed Np that ensures that the specified pressure QPx is obtained as the fuel pressure QP when the impeller 44 has swollen to the permissible limit at the time when of actuation of the fuel pump 30. The first threshold rotational speed Npth1 will be referred to as a swelling determination threshold. The fourth threshold rotational speed Npth4 is the value of the pump rotational speed Np that ensures that the specified pressure QPx is obtained as the fuel pressure QP when the inner wall of the pump chamber 38 or the impeller 44 has been worn to the permissible limit at the time when of actuation of the fuel pump 30. The fourth threshold rotational speed Npth4 will be referred to as a wear determination threshold. The clearance CL is maintained in the reference range when the rotational speed is in the range of the second threshold rotational speed Npth2 to the third threshold rotational speed Npth3. A value in this range can be referred to an initial value as the value of the pump rotational speed Np that ensures that the specified pressure QPx is obtained as the fuel pressure QP in the initial actuation period, that is, the specified period after initial energization of the fuel pump 30.

To diagnose the state of the fuel pump 30 in accordance with the items (A) to (E), the pump diagnosing section 12 memorizes the pump rotational speed Np at the time when the fuel pressure QP has risen to the specified pressure QPx through actuation of the fuel pump 30 and uses the memorized pump rotational speed Np in a diagnostic procedure.

Figure 6:
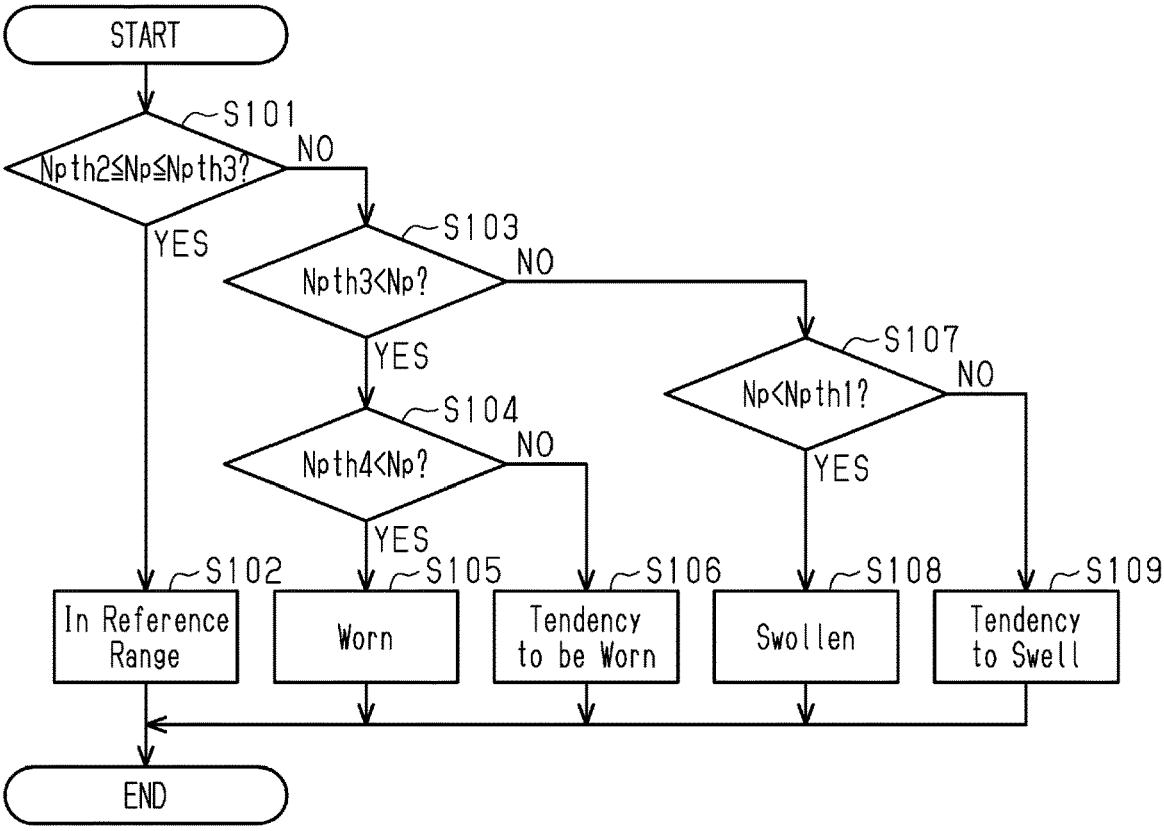
FIG. 6 is a flowchart showing a diagnostic procedure performed by the diagnostic apparatus of FIG. 1.

Referring to FIG. 6, an example of the diagnostic procedure performed by the pump diagnosing section 12 will be described. The routine of the present processing is initiated by the procedure in Step S12 of FIG. 3.

In the routine, the pump diagnosing section 12 determines whether the pump rotational speed Np at the time when the fuel pressure QP rises to the specified pressure QPx is in the range of the second threshold rotational speed Npth2 to the third threshold rotational speed Npth3 in Step S101. When the pump rotational speed Np is in the aforementioned range, that is, when the pump rotational speed Np is higher than or equal to the second threshold rotational speed Npth2 and smaller than or equal to the third threshold rotational speed Npth3 (S101: YES), Step S102 is carried out. In Step 102, the pump diagnosing section 12 determines that the size of the clearance CL is in the reference range. The routine of the current processing is then ended.

In contrast, when the pump rotational speed Np is outside the range of the second threshold rotational speed Npth2 to the third threshold rotational speed Npth3, that is, when the pump rotational speed Np is smaller than the second threshold rotational speed Npth2 or higher than the third threshold rotational speed Npth3 (S101: NO), Step S103 is carried out.

In Step S103, the pump diagnosing section 12 determines whether the pump rotational speed Np is higher than the third threshold rotational speed Npth3. When the pump rotational speed Np is higher than the third threshold rotational speed Npth3 (S103: YES), Step S104 is carried out. In contrast, if the pump rotational speed Np is smaller than the second threshold rotational speed Npth2 (S103: NO), Step S107 is carried out.

In Step S104, the pump diagnosing section 12 determines whether the pump rotational speed Np is higher than the fourth threshold rotational speed Npth4. When the pump rotational speed Np is higher than the fourth threshold rotational speed Npth4 (S104: YES), Step S105 is carried out. In Step S105, the pump diagnosing section 12 determines that the clearance CL is larger than the reference range, the inner wall of the pump chamber 38 or the impeller 44 is worn, and there is a sign of an anomaly. The routine of the current processing is then ended. In contrast, if the pump rotational speed Np is smaller than or equal to the fourth threshold rotational speed Npth4 (S104: NO), Step S106 is carried out. In Step S106, the pump diagnosing section 12 determines that the clearance CL is larger than the reference range and the inner wall of the pump chamber 38 or the impeller 44 has a tendency to wear. The routine of the current processing is then ended.

In Step S107, the pump diagnosing section 12 determines whether the pump rotational speed Np is smaller than the first threshold rotational speed Npth1. When the pump rotational speed Np is smaller than the first threshold rotational speed Npth1 (S107: YES), Step S108 is carried out. In Step S108, the pump diagnosing section 12 determines that the clearance CL is smaller than the reference range, the impeller 44 has swollen, and there is a sign of an anomaly. The routine of the current processing is then ended. In contrast, if the pump rotational speed Np is higher than or equal to the first threshold rotational speed Npth1 (S108: NO), Step S109 is carried out. In Step S109, the pump diagnosing section 12 determines that the clearance CL is smaller than the reference range and the impeller 44 has a tendency to swell. The routine of the current processing is then ended.

The operation and advantages of the present embodiment will now be described.

In many cases, a fuel pump has a small-sized thrust clearance to improve the discharge performance. Therefore, the thrust clearance becomes insufficient in size when the impeller of the fuel pump swells, which may stop the fuel pump. However, the control unit 10 of the present embodiment estimates the size of the clearance CL and, based on the estimated size of the clearance CL, detects a sign of an anomaly in the fuel pump 30. In other words, by estimating the clearance CL, the state of the fuel pump 30 in actuation is determined. This enables detecting a sign of an anomaly before the fuel pump 30 stops due to the problem.

The control unit 10 diagnoses the state of the fuel pump 30 with reference to the relationship between the pump rotational speed Np at the time when the fuel pressure QP rises to the specified pressure QPx through actuation of the fuel pump 30 and the size of the clearance CL. This enables detecting a sign of an anomaly that may be caused by swelling of the impeller 44 when the number of the pump rotational speed Np at the time when the fuel pressure QP has risen to the specified pressure QPx is smaller than the first threshold rotational speed Npth1 as the swelling determination threshold. In other words, a sign of an anomaly is detected before the fuel pump 30 stops due to the problem.

The control unit 10 detects a sign of an anomaly that may be caused by the wear of the inner wall of the pump chamber 38 or the impeller 44 if the value of the pump rotational speed Np at the time when the fuel pressure QP has risen to the specified pressure QPx is larger than the fourth threshold rotational speed Npth4, which is the wear determination threshold. This enables detecting a sign of lowered performance before the fuel pressure QP obtained through the actuation of the fuel pump 30 by a certain pump rotational speed Np becomes excessively low and thus lowers the performance of the fuel pump 30.

Figure 5:
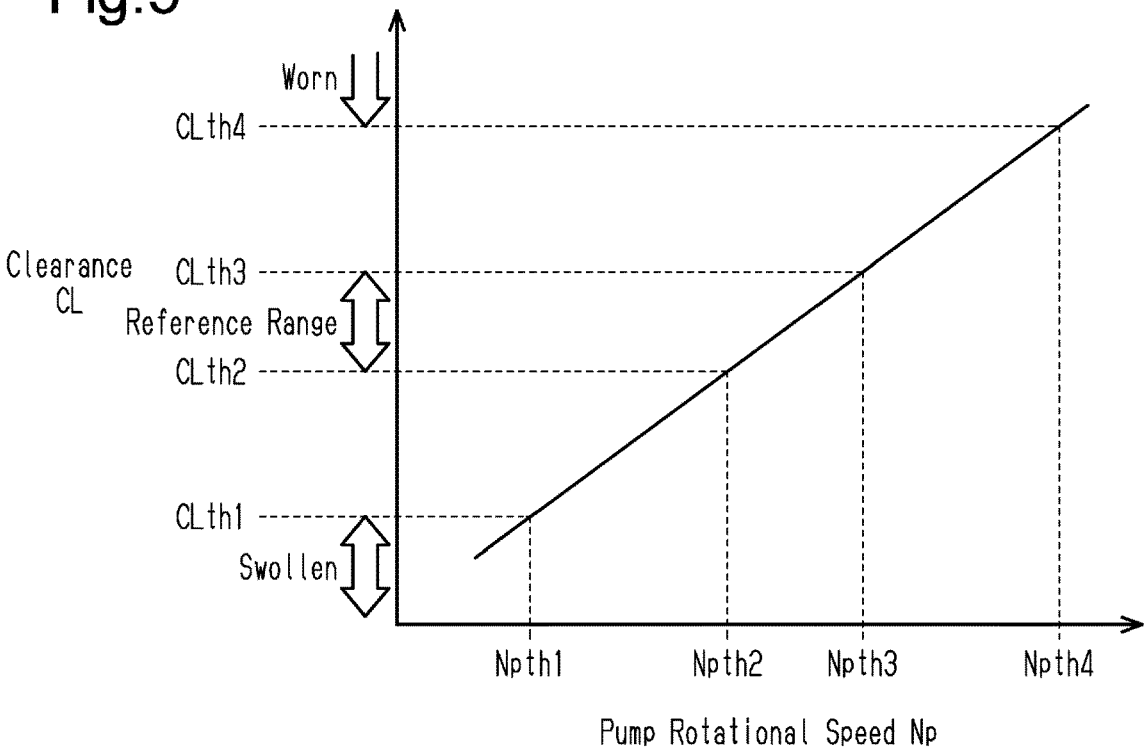
FIG. 5 is a graph showing the relationship between the pump rotational speed and thrust clearance.

With reference to FIGS. 4 and 5, the diagnostic procedure performed by the pump diagnosing section 12 of the control unit 10 sets the reference range of the clearance CL based on the clearance CL of the fuel pump in the initial actuation period with regard to the relationship between the pump rotational speed Np and the size of the clearance CL. If the pump rotational speed Np is significantly different from the values corresponding to the reference range, it is indicated that a problem is likely to happen even if the problem has not yet been produced. The diagnostic procedure of the present embodiment diagnoses that the impeller 44 has swollen to a more progressed stage as the pump rotational speed Np is more significantly different from the values corresponding to the reference range and is closer to the first threshold rotational speed Npth1 as the swelling determination threshold. This enables detecting progressed swelling in the impeller 44 before a problem occurs in the fuel pump 30.

The diagnostic procedure of the present embodiment diagnoses that the inner wall of the pump chamber 38 or the impeller 44 has been worn to a more progressed stage as the pump rotational speed Np is more significantly different from the values corresponding to the reference range and is closer to the fourth threshold rotational speed Npth4, which is the wear determination threshold. This enables detecting progressed wear of the inner wall of the pump chamber 38 or the impeller 44 before a problem occurs in the fuel pump 30.

In the fuel pump 30, swelling of the impeller 44 and wear of the inner wall of the pump chamber 38 or the impeller 44 may progress simultaneously. In this case, the clearance CL may be reduced in size through the swelling but enlarged through the wear and thus remain in the reference range. This maintains the discharge performance of the fuel pump 30, regardless of the wear and swelling. The diagnostic procedure of the present embodiment determines the state of the fuel pump 30 in actuation by estimating the clearance CL based on the pump rotational speed Np. Therefore, according to the diagnostic procedure, detection of a sign of an anomaly does not happen if the performance of the fuel pump 30 is maintained even with the wear and swelling occurring.

The above-described embodiment may be modified as follows. The above-described embodiment and the following modifications can be combined as long as the combined modifications remain technically consistent with each other.

In the above-described embodiment, the procedure of detecting a sign of an anomaly occurring in the fuel pump 30 with reference to the flowchart of FIG. 6 has been illustrated as the diagnostic procedure performed in Step S12 of FIG. 3. However, the diagnostic procedure performed in Step S12 may be a procedure of detecting a sign of an anomaly using the size of the clearance CL with respect to the pump rotational speed Np at the time when the fuel pressure QP rises to the specified pressure QPx, with reference to a map memorizing the relationship shown in FIG. 5.

In the above-described embodiment, the diagnostic procedure of detecting a sign of an anomaly occurring in the fuel pump 30 is configured to detect the sign of an anomaly by estimating the size of the clearance CL based on the pump rotational speed Np at the time when the fuel pressure QP rises to the specified pressure QPx. However, if determination is carried out based on the relationship shown in FIG. 5, a sign of an anomaly, that is, the swelling of the impeller 44 or the wear of the inner wall of the pump chamber 38 or the impeller 44, is detected by determining which of the zones divided according to the respective first to fourth threshold rotational speed Npth1 to Npth4 the pump rotational speed Np falls in. In other words, the diagnostic procedure of detecting a sign of an anomaly occurring in the fuel pump 30 does not necessarily have to include estimating the clearance CL based on the pump rotational speed Np.

The flow of the procedures in the above-described embodiment shown in FIG. 3 may be executed repeatedly. In other words, the pump diagnosing section 12 may execute the diagnostic procedure repeatedly. While the diagnostic procedure is repeated, the pump control of Step S11 must actuate the fuel pump 30 on the same conditions. For example, the motor voltage of the fuel pump 30 must be unchanged.

As the pump diagnosing section 12 repeats the diagnostic procedure, the pump rotational speed Np at the time when the fuel pressure QP rises to the specified pressure QPx may become smaller in the current cycle of diagnosis than in the last cycle of diagnosis. This indicates that the clearance CL has become larger than in the last cycle of diagnosis, thus enabling the progressed swelling of the impeller 44 as a sign of an anomaly. In contrast, if the pump rotational speed Np at the time when the fuel pressure QP rises to the specified pressure QPx is higher in the current cycle of diagnosis than in the last diagnosis, the clearance CL is smaller than in the last cycle of diagnosis. This enables detecting the progressed wear of the inner wall of the pump chamber 38 or the impeller 44 as a sign of an anomaly.

If swelling of the impeller 44 and wear of the inner wall of the pump chamber 38 or the impeller 44 progress simultaneously and the impeller 44 is detected to have a tendency to swell, the clearance CL may later return to the reference range depending on the speed at which the swelling or wear progresses. Therefore, the diagnostic accuracy is improved by executing the diagnostic procedure repeatedly as in the above-described configuration.

In the above-described embodiment, the diagnostic procedure of detecting a sign of an anomaly occurring in the fuel pump 30 based on the relationship between the pump rotational speed Np and the clearance CL has been described. However, contents of the diagnostic procedure may be modified. For example, in the actuation of the fuel pump 30 by the FPC 13, the value of the pump rotational speed Np in the F/F control may be defined as an initial rotational speed. In this case, the amount by which the pump rotational speed Np changes from the initial rotational speed due to the F/B control is defined as a change in rotational speed ΔNp. A diagnostic procedure of detecting a sign of an anomaly occurring in the fuel pump 30 may be carried out using the change in rotational speed ΔNp.

Figure 7:
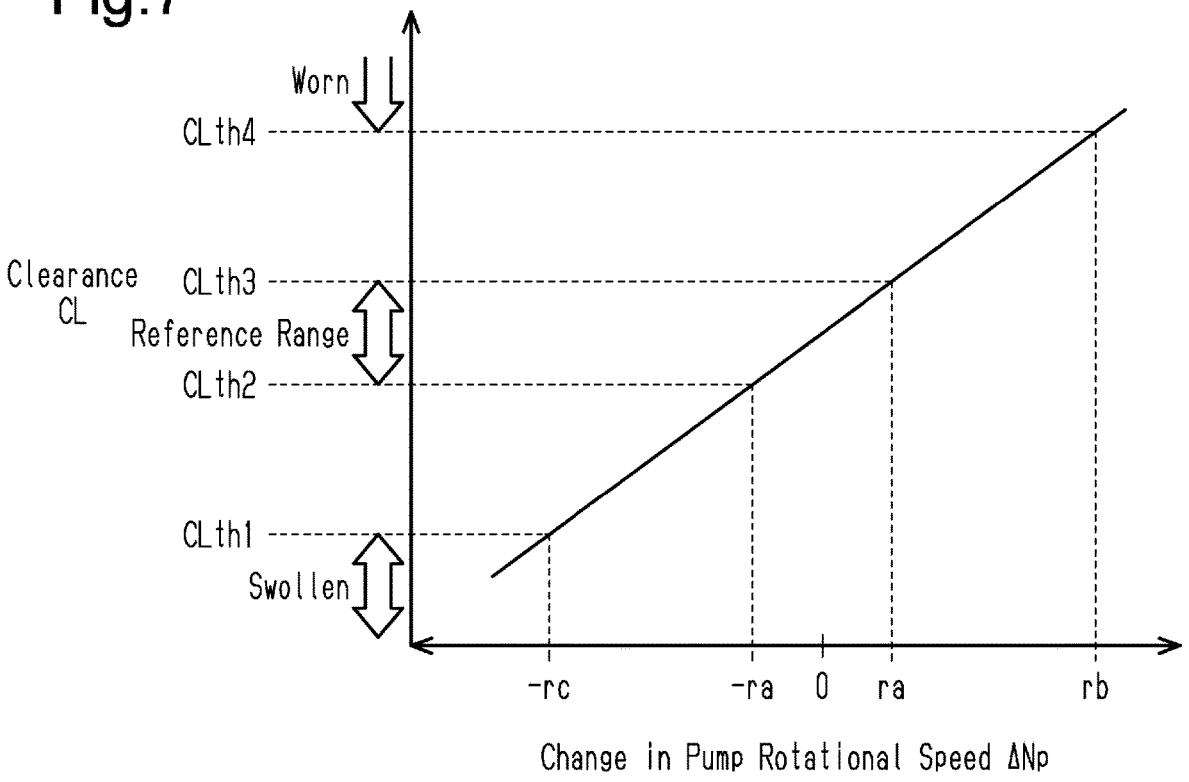
FIG. 7 is a graph related to a diagnostic procedure performed by a diagnostic apparatus according to a modification.

With reference to FIG. 7, the relationship between the change in rotational speed ΔNp and the clearance CL related to the diagnostic procedure will be described. Referring to FIG. 4, the larger the clearance CL, the lower the fuel pressure QP for the predetermined pump rotational speed Np. Therefore, as shown in FIG. 7, the greater the change in rotational speed ΔNp, the larger the clearance CL becomes.

With reference to FIG. 7, the value of the change in rotational speed ΔNp corresponding to the wear limit value CLth4 is the value rb. The value of the change in rotational speed ΔNp corresponding to the upper limit acceptable value CLth3 is the value ra. The value ra is smaller than the value rb. The value of the change in rotational speed ΔNp corresponding to the lower limit acceptable value CLth2 is the value −ra. The value of change in rotational speed ΔNp corresponding to the swelling limit value CLth1 is the value −rc. The value −rc is smaller than the value −ra. In other words, the items (F) to (J), as will be described below, are derived from the relationship shown in FIG. 7.

(F) If the change in rotational speed ΔNp is smaller than or equal to the value ra, that is, in the case of $\Delta Np \leq |ra|$, the size of the clearance CL of the fuel pump 30 is maintained in the reference range.

(G) If the change in rotational speed ΔNp is smaller than the value −ra, that is, in the case of $\Delta Np < -ra$, the clearance CL is smaller than the reference range and the impeller 44 has a tendency to swell.

(H) If the change in rotational speed ΔNp is smaller than the value −rc, that is, in the case of $\Delta Np < -rc$, the clearance CL is smaller than the reference range and the fuel pump 30 may stop due to the swelling of the impeller 44.

(I) If the change in rotational speed ΔNp is greater than the value ra, that is, in the case of $\Delta Np > ra$, the clearance CL is larger than the reference range and the inner wall of the pump chamber 38 or the impeller 44 may have a tendency to wear.

(J) If the change in rotational speed ΔNp is greater than the value rb, that is, in the case of $\Delta Np > rb$, the clearance CL is larger than the reference range and the performance of the fuel pump 30 has been lowered due to the wear of the inner wall of the pump chamber 38 or the impeller 44.

The state of the fuel pump 30 is diagnosed based on the above-described items (F) to (J). For example, the FPC 13 may memorize, as the change in rotational speed ΔNp, the change amount of the pump rotational speed Np in the period from when the F/B control is started to when the actual discharged amount reaches the requested discharged amount QVT. A diagnostic procedure may be performed using the change in rotational speed ΔNp. Alternatively, in the F/B control, the change in rotational speed ΔNp may be monitored sequentially as the change amount of the rotational speed Np. When the change in rotational speed ΔNp becomes smaller than the value −ra, a determination that the fuel pump 30 may stop due to the swelling of the impeller 44 is made. These diagnostic procedures also determine the state of the fuel pump 30 in actuation, as in the above-described embodiment, thus enabling detecting a sign of an anomaly occurring in the fuel pump 30.

Figure 8:
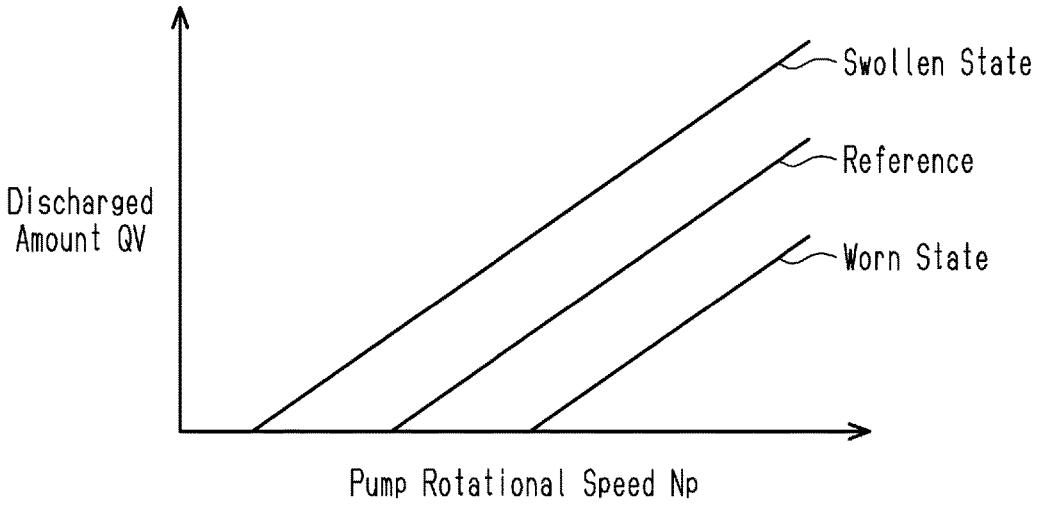
FIG. 8 is a graph related to a diagnostic procedure performed by a diagnostic apparatus according to another modification.

Contents of the diagnostic procedures may be modified as will be described. The discharged amount QV of the fuel pump 30 per unit time at the time when the pump rotational speed Np is controlled to a certain rotational speed has a proportional relationship with the fuel pressure QP. Therefore, referring to FIG. 8, there are correlations similar to the relationships shown in FIG. 4 between the pump rotational speed Np and the discharged amount QV in the respective states of the fuel pump 30. In other words, in the correlation between the pump rotational speed Np and the discharged amount QV of the fuel pump in a swollen state, the discharged amount QV is greater than in the initial correlation for a common pump rotational speed Np. In contrast, in the correlation between the pump rotational speed Np and the discharged amount QV of the fuel pump in a worn state, the discharged amount QV is smaller than in the initial correlation for a common pump rotational speed Np. When the FPC 13 performs the F/F control, the pump rotational speed Np is controlled to a constant target rotational speed NpT. The time necessary for raising the fuel pressure QP by a predetermined amount at the time when the pump rotational speed Np is controlled to the target rotational speed NpT is defined as a pressure raising time T. With reference to FIG. 8, the larger the clearance CL, the smaller the discharged amount QV for a common pump rotational speed Np becomes. Therefore, referring to FIG. 9, the larger the clearance CL, the longer the pressure raising time T becomes, when at the constant pump rotational speed Np. A diagnostic procedure may be carried out based on the relationship between the pressure raising time T and the clearance CL shown in FIG. 9.

Figure 9:
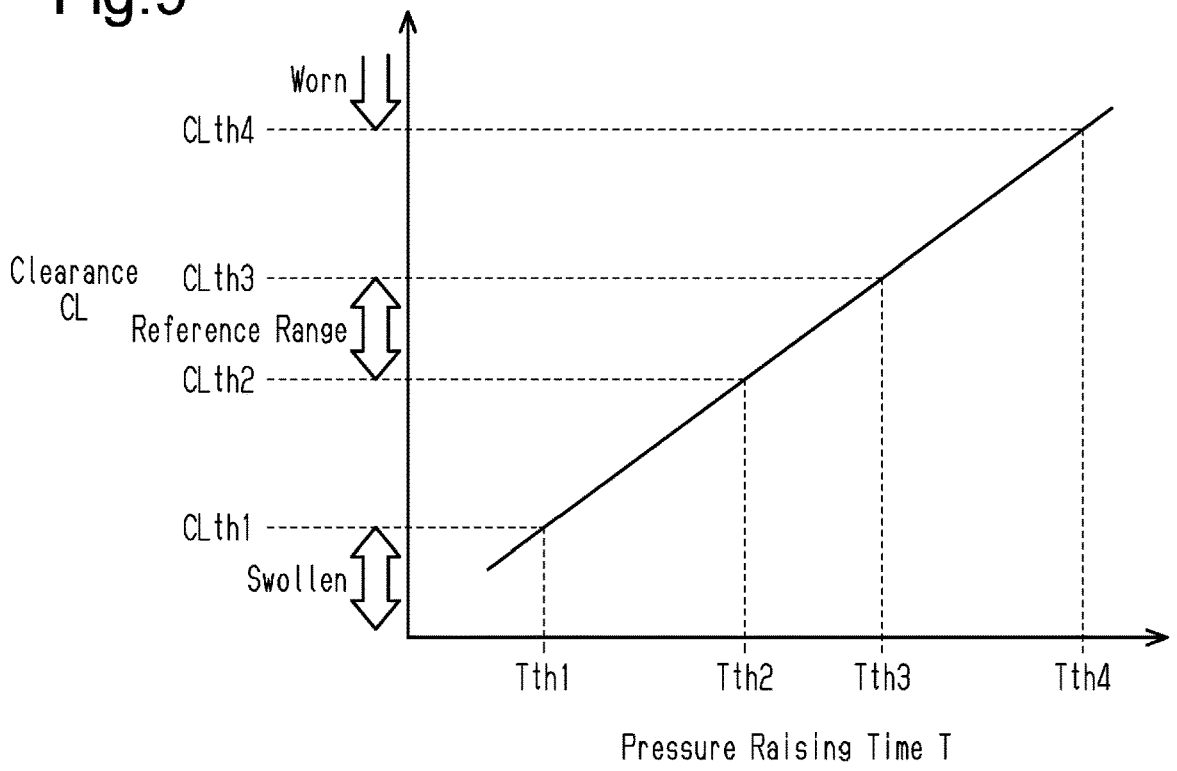
FIG. 9 is a graph related to the diagnostic procedure performed by the diagnostic apparatus according to the modification of FIG. 8.

The items (K) to (O), as will be described below, are derived from the relationship shown in FIG. 9.

(K) If the pressure raising time T is in the range of a second threshold time Tth2, which corresponds to the lower limit acceptable value CLth2, to a third threshold time Tth3, which corresponds to the upper limit acceptable value CLth3, the size of the clearance CL of the fuel pump 30 is maintained in the reference range.

(L) If the pressure raising time T is smaller than the second threshold time Tth2, which corresponds to the lower limit acceptable value CLth2, the clearance CL is smaller than the reference range and the impeller 44 has a tendency to swell.

(M) If the pressure raising time T is smaller than a first threshold time Tth1, which corresponds to the swelling limit value CLth1, the clearance CL is smaller than the reference range and the fuel pump 30 may stop due to the swelling of the impeller 44.

(N) If the pressure raising time T is longer than the third threshold time Tth3, which corresponds to the upper limit acceptable value CLth3, the clearance CL is larger than the reference range, and the inner wall of the pump chamber 38 or the impeller 44 has a tendency to wear.

(O) If the pressure raising time T is longer than a fourth threshold time Tth4, which corresponds to the wear limit value CLth4, the clearance CL is larger than the reference range, and the performance of the fuel pump 30 has been lowered due to the wear of the inner wall of the pump chamber 38 or the impeller 44.

The state of the fuel pump 30 may be diagnosed based on the above-described items (K) to (O). As in the above-described embodiment, this diagnostic procedure determines the state of the fuel pump 30 in actuation and detects a sign of an anomaly occurring in the fuel pump 30.

In the above-described embodiment, the diagnostic procedure performed based on the relationship between the pump rotational speed Np at the time when the fuel pressure QP rises to the specified pressure QPx and the size of the clearance CL, as shown in FIG. 5, has been illustrated by way of example. There is correlation between the pump rotational speed Np and the discharged amount QV in the respective states of the fuel pump 30, referring to FIG. 8. Therefore, a diagnostic procedure may be performed based on the relationship between the pump rotational speed Np at the time when a certain discharged amount QV is obtained through actuation of the fuel pump 30 and the size of the clearance CL. This diagnostic procedure, as in the above-described embodiment, determines the state of the fuel pump 30 in actuation and detects a sign of an anomaly occurring in the fuel pump 30.

Figure 10:
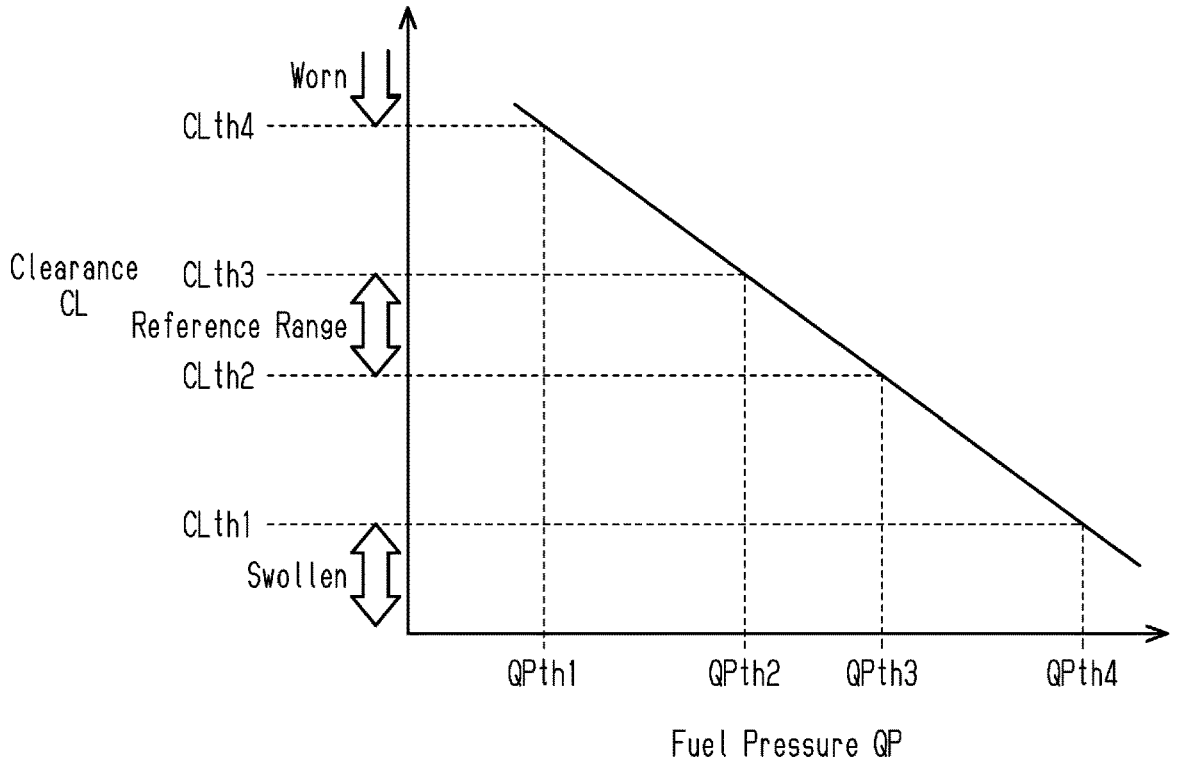
FIG. 10 is a graph related to a diagnostic procedure performed by a diagnostic apparatus according to another modification.

Contents of the diagnostic procedure may be modified as will be described. As shown in FIG. 4, the larger the clearance CL, the lower the fuel pressure QP for a predetermined pump rotational speed Np. Therefore, referring to FIG. 10, the lower the fuel pressure QP, the larger the clearance CL, when at a constant pump rotational speed Np. Specifically, when the FPC 13 performs the F/F control, the pump rotational speed Np is controlled to a constant target rotational speed NpT. Using the fuel pressure QP at the time when the pump rotational speed Np is controlled to the target rotational speed NpT, a diagnostic procedure may be performed based on the relationship between the fuel pressure QP and the clearance CL, as shown in FIG. 10.

The items (P) to (T), as will be described below, are derived from the relationship shown in FIG. 10.

(P) If the fuel pressure QP at the time when the pump rotational speed Np is controlled to the target rotational speed NpT is in the range of a second threshold fuel pressure QPth2 corresponding to the upper limit acceptable value CLth3 to a third threshold fuel pressure QPth3 corresponding to the lower limit acceptable value CLth2, the size of the clearance CL is maintained in the reference range.

(Q) If the fuel pressure QP is higher than the third threshold fuel pressure QPth3, which corresponds to the lower limit acceptable value CLth2, the clearance CL is smaller than the reference range and the impeller 44 tends to swell.

(R) If the fuel pressure QP is higher than a fourth threshold fuel pressure QPth4 corresponding to the swelling limit value CLth1, the clearance CL is smaller than the reference range and the fuel pump 30 may stop due to the swelling of the impeller 44.

(S) If the fuel pressure QP is lower than the second threshold fuel pressure QPth2, which corresponds to the upper limit acceptable value CLth3, the clearance CL is larger than the reference range and the inner wall of the pump chamber 38 or the impeller 44 has a tendency to wear.

(T) If the fuel pressure QP is lower than a first threshold fuel pressure QPth1 corresponding to the wear limit value CLth4, the clearance CL is larger than the reference range and the performance of the fuel pump 30 has been lowered due to the wear of the inner wall of the pump chamber 38 or the impeller 44.

The state of the fuel pump 30 may be diagnosed based on the items (P) to (T).

Figure 11:
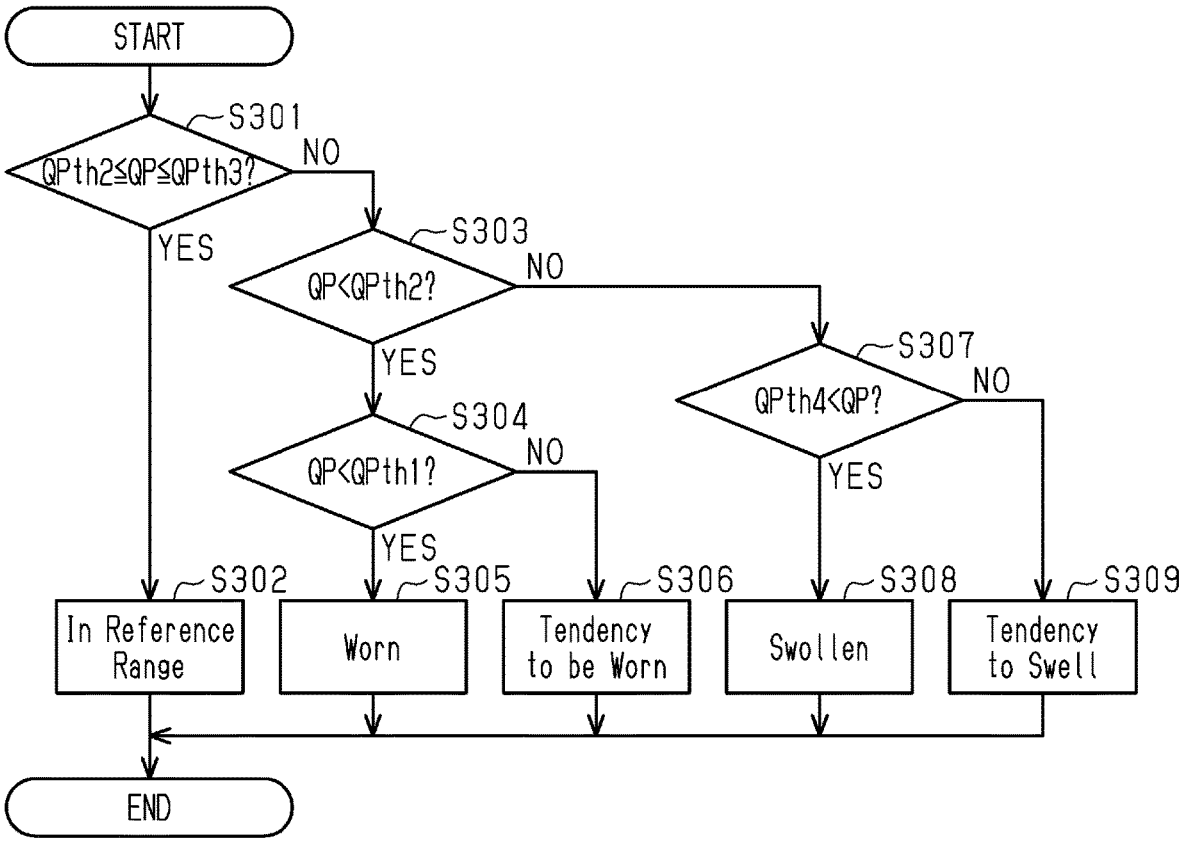
FIG. 11 is a flowchart showing the diagnostic procedure performed by the diagnostic apparatus according to the modification of FIG. 10.

With reference to FIG. 11, an example of a diagnostic procedure performed by the pump diagnosing section 12 will be described. The routine of the present processing is initiated by the procedure in Step S12 of FIG. 3.

In the routine, the pump diagnosing section 12 determines in Step S301 whether the fuel pressure QP at the time when the pump rotational speed Np is controlled to the target rotational speed NpT is in the range of the second threshold fuel pressure QPth2 to the third threshold fuel pressure QPth3. If the fuel pressure QP is in the aforementioned range, that is, if the fuel pressure QP is higher than or equal to the second threshold fuel pressure QPth2 and smaller than or equal to the third threshold fuel pressure QPth3 (S301: YES), Step S302 is carried out. In Step S302, the pump diagnosing section 12 determines that the size of the clearance CL is in the reference range. The routine of the current processing is then ended.

In contrast, when the fuel pressure QP is outside the range of the second threshold fuel pressure QPth2 to the third threshold fuel pressure QPth3, that is, when the fuel pressure QP is lower than the second threshold fuel pressure QPth2 or higher than the third threshold fuel pressure QPth3 (S301: NO), Step S303 is carried out.

In Step S303, the pump diagnosing section 12 determines whether the fuel pressure QP is lower than the second threshold fuel pressure QPth2. If the fuel pressure QP is lower than the second threshold fuel pressure QPth2 (S303: YES), Step S304 is carried out. In contrast, when the fuel pressure QP is higher than the third threshold fuel pressure QPth3 (S303: NO), Step S307 is carried out.

In Step S304, the pump diagnosing section 12 determines whether the fuel pressure QP is lower than the first threshold fuel pressure QPth1. If the fuel pressure QP is lower than the first threshold fuel pressure QPth1 (S304: YES), Step S305 is carried out. In Step S305, the pump diagnosing section 12 determines that the clearance CL is larger than the reference range, the inner wall of the pump chamber 38 or the impeller 44 is worn, and there is a sign of an anomaly. The routine of the current processing is then ended. In contrast, if the fuel pressure QP is higher than or equal to the first threshold fuel pressure QPth1 (S304: NO), Step S306 is carried out. In Step S306, the pump diagnosing section 12 determines that the clearance CL is larger than the reference range and the inner wall of the pump chamber 38 or the impeller 44 has a tendency to wear. The routine of the current processing is then ended.

In Step S307, the pump diagnosing section 12 determines whether the fuel pressure QP is higher than the fourth threshold fuel pressure QPth4. If the fuel pressure QP is higher than the fourth threshold fuel pressure QPth4 (S307: YES), Step S308 is carried out. In Step S308, the pump diagnosing section 12 determines that the clearance CL is smaller than the reference range, the impeller 44 has swollen, and there is a sign of an anomaly. The routine of the current processing is then ended. In contrast, if the fuel pressure QP is lower than or equal to the fourth threshold fuel pressure QPth4 (S307: NO), Step S309 is carried out. In Step S309, the pump diagnosing section 12 determines that the clearance CL is smaller than the reference range and the impeller 44 has a tendency to swell. The routine of the current processing is then ended.

As in the above-described embodiment, this diagnostic procedure determines the state of the fuel pump 30 in actuation and detects a sign of an anomaly occurring in the fuel pump 30.

The embodiment is configured to perform the diagnostic procedure after the pump control carried out by the FPC 13. The pump control may be a pump control in which the fuel pump 30 is actuated based on the requested discharged amount QVT, which is calculated by the ECU 11 for the fuel injection through the fuel injection valves 26. Alternatively, the pump control may be a pump control in which the fuel pump 30 is actuated to perform a diagnostic procedure, regardless of the timings at which fuel is injected through the fuel injection valves 26.

In the above-described embodiment, the pump diagnosing section 12 included in the ECU 11 of the vehicle has been illustrated by way of example. However, the pump diagnosing section 12 for performing a diagnostic procedure may be mounted in a computing device located in the exterior of the vehicle. In other words, a diagnostic apparatus for a fuel pump may be constituted by the FPC 13 arranged in the control unit 10 of the vehicle and the pump diagnosing section 12 mounted in the computing device located in the exterior of the vehicle. For example, the diagnostic apparatus may be configured such that data is transmitted and received between the control unit 10 and the computing device via an external communication circuit network. This allows the computing device to receive data including the pump rotational speed Np from the control unit 10 and then perform a diagnostic procedure. As in the above-described embodiment, this diagnostic procedure determines the state of the fuel pump 30 in actuation and detects a sign of an anomaly occurring in the fuel pump 30.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A diagnostic apparatus for a fuel pump mounted in a fuel supply system, wherein the fuel pump has a pump chamber, an impeller accommodated in the pump chamber, and a motor for rotating the impeller, and the fuel pump is configured to draw in fuel from a fuel tank and discharge the fuel by rotation of the impeller, the diagnostic apparatus comprising:

processing circuitry that is configured to diagnose a state of the fuel pump based on a correlation between a pump rotational speed that is a rotational speed of the motor and fuel pressure that is pressure of the fuel discharged from the fuel pump, and an initial correlation that is the correlation in an initial actuation period from when the fuel pump is energized for the first time to when a specified period has elapsed, wherein:

a first value of the pump rotational speed at a time when a first specified pressure is obtained as the fuel pressure in a case in which the impeller has swollen to a permissible limit is a swelling determination threshold, a second value of the pump rotational speed at a time when a second specified pressure is obtained as the fuel pressure in a case in which an inner wall of the pump chamber or the impeller has been worn to a permissible limit is a wear determination threshold, a third value of the pump rotational speed at a time when the first specified pressure or the second specified pressure is obtained as the fuel pressure in the initial actuation period is an initial value, and the processing circuitry is configured to detect at least one of:

a sign of an anomaly that can be caused by a swelling of the impeller as a sign of an anomaly occurring in the fuel pump when a fourth value of the pump rotational speed at a time when the first specified pressure is obtained as the fuel pressure is lower than the swelling determination threshold, a sign of an anomaly that can be caused by a wear of the inner wall of the pump chamber or the impeller as a sign of an anomaly occurring in the fuel pump when a fifth value of the pump rotational speed at a time when the second specified pressure is obtained as the fuel pressure is higher than the wear determination threshold, a swelling of the impeller becomes progressed as compared to a swelling in the initial actuation period as a sixth value of the pump rotational speed at a time when the first specified pressure is obtained as the fuel pressure becomes closer to the swelling determination threshold than to the initial value, or a wear of the inner wall of the pump chamber or the impeller becomes progressed as compared to a wear in the initial actuation period as a seventh value of the pump rotational speed at a time when the second specified pressure is obtained as the fuel pressure becomes closer to the wear determination threshold than to the initial value.

2. A diagnostic apparatus for a fuel pump mounted in a fuel supply system, wherein the fuel pump has a pump chamber, an impeller accommodated in the pump chamber, and a motor for rotating the impeller, and the fuel pump is configured to draw in fuel from a fuel tank and discharge the fuel by rotation of the impeller, the diagnostic apparatus comprising:

processing circuitry that is configured to diagnose a state of the fuel pump based on a correlation between a pump rotational speed that is a rotational speed of the motor and fuel pressure that is pressure of the fuel discharged from the fuel pump, and an initial correlation that is the correlation in an initial actuation period from when the fuel pump is energized for the first time to when a specified period has elapsed, wherein the processing circuitry is configured to estimate a size of a thrust clearance that is a clearance between the impeller and an inner wall of the pump chamber in the axial direction of a rotary shaft of the motor based on the correlation between the pump rotational speed and the fuel pressure and the initial correlation, and detect a sign of an anomaly in the fuel pump based on the estimated size of the thrust clearance.

3. A diagnostic apparatus for a fuel pump mounted in a fuel supply system, wherein the fuel pump has a pump chamber, an impeller accommodated in the pump chamber, and a motor for rotating the impeller, and the fuel pump is configured to draw in fuel from a fuel tank and discharge the fuel by rotation of the impeller, the diagnostic apparatus comprising:

processing circuitry that is configured to diagnose a state of the fuel pump based on a correlation between a pump rotational speed that is a rotational speed of the motor and fuel pressure that is pressure of the fuel discharged from the fuel pump, and an initial correlation that is the correlation in an initial actuation period from when the fuel pump is energized for the first time to when a specified period has elapsed, wherein the processing circuitry is configured to repeatedly execute the diagnosis by actuating the fuel pump on same conditions as the conditions on which the fuel pump was actuated in a last cycle of diagnosis, and detect at least one of:

a swelling of the impeller is progressed as compared to the last cycle of diagnosis based on a difference in the pump rotational speed between the current cycle of diagnosis and the last cycle of diagnosis, or a wear of an inner wall of the pump chamber or the impeller is progressed as compared to the last cycle of diagnosis based on a difference in the pump rotational speed between the current cycle of diagnosis and the last cycle of diagnosis.

* * * * *